US008495776B1

(12) United States Patent
Kotob

(10) Patent No.: US 8,495,776 B1
(45) Date of Patent: Jul. 30, 2013

(54) TOY SLEEVE

(76) Inventor: Angela Kotob, San Diego, CA (US)

( * ) Notice: Subject to any disclaimer, the term of this patent is extended or adjusted under 35 U.S.C. 154(b) by 0 days.

(21) Appl. No.: 13/472,094

(22) Filed: May 15, 2012

(51) Int. Cl.
*A47G 9/00* (2006.01)
*A47C 16/00* (2006.01)

(52) U.S. Cl.
USPC ..... 5/655; 5/657; 5/652

(58) Field of Classification Search
USPC ..... 5/655, 652, 657, 636, 638, 639, 640, 5/645, 632, 630, 417, 419, 420, 502, 496, 5/490, 485, 482; 2/59; 224/158, 159; 446/227; D2/610–614
See application file for complete search history.

(56) References Cited

U.S. PATENT DOCUMENTS

| | | | | |
|---|---|---|---|---|
| 579,256 | A | 3/1897 | Bukolt | |
| 2,078,022 | A * | 4/1937 | Roemer | 446/227 |
| 4,393,520 | A * | 7/1983 | Koch | 2/16 |
| 4,540,219 | A * | 9/1985 | Klinger | 297/487 |
| 4,815,639 | A * | 3/1989 | Lehman | 224/159 |
| D315,845 | S | 4/1991 | Lafley | |
| 5,159,727 | A | 11/1992 | McCracken | |
| 5,208,934 | A * | 5/1993 | Bachnick et al. | 5/482 |
| 5,239,717 | A * | 8/1993 | Sue | 5/655 |
| 5,440,769 | A | 8/1995 | Thomas | |
| D371,266 | S * | 7/1996 | Ward | D6/596 |
| 5,546,620 | A * | 8/1996 | Matthews | 5/655 |
| 5,618,263 | A * | 4/1997 | Alivizatos | 602/6 |
| 5,707,031 | A * | 1/1998 | Creighton-Young | 248/118 |
| 5,715,535 | A * | 2/1998 | Hamilton et al. | 2/59 |
| 6,038,720 | A * | 3/2000 | Matthews et al. | 5/639 |
| 6,298,509 | B1 * | 10/2001 | Vickers | 5/655 |
| 6,381,786 | B1 | 5/2002 | Cadden | |
| 6,481,032 | B2 * | 11/2002 | Milano et al. | 5/655 |
| D477,173 | S * | 7/2003 | Nagy-Marczyk | D6/601 |
| D479,938 | S * | 9/2003 | Quirk et al. | D6/603 |
| 6,684,422 | B2 * | 2/2004 | LeFevre et al. | 5/496 |
| 6,694,552 | B1 * | 2/2004 | Vickers | 5/655 |
| 6,785,921 | B1 * | 9/2004 | Conforti | 5/655 |
| 6,918,148 | B2 * | 7/2005 | Auxila | 5/655 |
| 7,062,807 | B2 * | 6/2006 | Conforti | 5/655 |
| 7,131,156 | B1 | 11/2006 | Walker-Craft | |
| 7,146,663 | B2 * | 12/2006 | Brown et al. | 5/636 |
| 7,350,252 | B2 * | 4/2008 | Telegadis et al. | 5/655 |
| D578,818 | S * | 10/2008 | Margalit | D6/601 |
| D579,256 | S | 10/2008 | Alfieri | |
| D593,787 | S | 6/2009 | Dafna | |
| D608,526 | S * | 1/2010 | Boesl | D2/610 |
| 7,694,371 | B2 * | 4/2010 | Telegadis et al. | 5/655 |
| 7,962,984 | B2 * | 6/2011 | Popp | 5/640 |
| 8,381,334 | B2 * | 2/2013 | Ballard | 5/502 |

(Continued)

FOREIGN PATENT DOCUMENTS

WO WO 9409689 A1 * 5/1994

*Primary Examiner* — Robert G Santos
(74) *Attorney, Agent, or Firm* — Nydegger and Associates

(57) ABSTRACT

An infant adaptable system includes a rectangular-shaped base member that is made of a soft, flexible material and has a plurality of holes formed between, and parallel to, the sides of the base member. A first cushion and a second cushion are mounted on the base member between the holes and a respective side of the base member. Fasteners are provided along each side of the base member for engagement with each other to configure the system for wear on an arm of a user or for attachment to an infant carrier. Toys can be selectively engaged with the holes on the base member, and held on the base member, to distract the infant during a use of the system.

20 Claims, 2 Drawing Sheets

U.S. PATENT DOCUMENTS

| | | | | |
|---|---|---|---|---|
| 2002/0020021 | A1* | 2/2002 | Milano et al. | 5/655 |
| 2003/0159193 | A1* | 8/2003 | LeFevre et al. | 2/69.5 |
| 2005/0005361 | A1* | 1/2005 | Conforti | 5/655 |
| 2005/0044633 | A1* | 3/2005 | Auxila | 5/655 |
| 2005/0097673 | A1* | 5/2005 | Matthews Brown et al. | 5/636 |
| 2006/0179574 | A1* | 8/2006 | Margalit | 5/655 |
| 2006/0282953 | A1* | 12/2006 | Telegadis et al. | 5/655 |
| 2008/0141462 | A1* | 6/2008 | Woods | 5/655 |
| 2008/0209640 | A1* | 9/2008 | Telegadis et al. | 5/655.9 |
| 2008/0250567 | A1* | 10/2008 | Pillarl | 5/655 |
| 2008/0313813 | A1* | 12/2008 | Adiri et al. | 5/655 |
| 2009/0222993 | A1* | 9/2009 | Villanueva et al. | 5/655 |
| 2010/0043147 | A1* | 2/2010 | Popp | 5/636 |
| 2011/0154572 | A1 | 6/2011 | Fair | |
| 2012/0073048 | A1* | 3/2012 | Ballard | 5/485 |

* cited by examiner

TOY SLEEVE

FIELD OF THE INVENTION

The present invention pertains generally to multi-purpose infant carrying systems. More particularly, the present invention pertains to systems that are useful for transporting and/or supporting an infant. The present invention is particularly, but not exclusively, useful as a system for assisting in the transport and/or support of an infant while simultaneously providing the infant with easy access to playthings that can be attached to the system, and useful as a system for holding and nursing an infant, as well as providing a convenient pillow for the infant.

BACKGROUND OF THE INVENTION

When they are awake, infants require, and indeed often demand, almost constant attention. Unless they are preoccupied, distracted, or otherwise entertained, infants can easily monopolize all of the person's time (parent or nurse) who is caring for them. Unfortunately, this can often detract from the person's ability to perform other secondary, but necessary, tasks. As is well known, a very effective way to distract infants, even if only temporarily, is to give them something to play with (e.g. toys).

When an infant is uncomfortable, which can happen frequently and is typically unannounced, the need to entertain the infant is no longer a requirement. Instead, under such circumstances, it is very desirable that the infant be made as comfortable as possible. Stated differently, it is always desirable to have a pillow conveniently accessible for use. This will be the case regardless whether the infant is being carried in the arms of a person, or is being carried in a hand-held device such as a baby carrier, or is being transported in a mobile contrivance such as a stroller or an infant car seat.

With the above in mind, it is an object of the present invention to provide an infant adaptable system which can be selectively converted either for wear on the arm of a user (parent or nurse) or attached to a mobile contrivance during transport of the infant. Another object of the present invention is to provide an infant adaptable system which supports playthings (e.g. toys) to distract the infant during a use of the system, and which provides comfortable support as a pillow for the infant during the use of the system. Yet another object of the present invention is to provide a system that conveniently supports the infant while he/she is nursing. Still another object of the present invention is to provide an infant adaptable system which is simple to use, is easy to manufacture, and is comparatively cost effective.

SUMMARY OF THE INVENTION

In accordance with the present invention, an infant adaptable system is provided which allows a user to carry, transport or supervise an infant while providing the infant with easy access to distractive entertainment, such as playthings (i.e. toys). In particular, the present invention can be configured for wear on the arm of a user (e.g. parent or nurse), or engaged with a device that is designed for carrying or transporting an infant, such as an infant car seat or a stroller. Also, the present invention can be laid out flat on a surface (e.g. the floor or a bed) and be used as a pillow. In any event, the infant adaptable system of the present invention is intended to provide both entertainment and comfort for the infant.

Structurally, the infant adaptable system of the present invention includes a substantially rectangular shaped base member. The base member is made of a flexible material (preferably a fabric), and it defines a first edge (top) and a second edge (bottom), with a first side and a second side extending between the edges. With this structure, the base member defines an unspecified axis that is substantially parallel to both the first side and the second side.

A plurality of holes is formed into the base member, and they are aligned substantially parallel to the axis. Also included with the system are a first cushion and a second cushion that are mounted on the base member to straddle the plurality of holes. More specifically, each cushion is aligned substantially parallel to the axis, and each cushion is positioned between the plurality of holes and a respective side of the base member. To do this, the base member is formed with a first pocket having an opening for receiving the first cushion into the first pocket through the opening. Also, the base member is formed with a second pocket having an opening for receiving the second cushion into the second pocket through its opening. As envisioned for the present invention, each cushion which is inserted into a respective pocket may be selectively made of pillow batting, beads or some form of memory foam. In the specific case where beads are used for the cushions, the present invention further envisions that the beads may be warmed prior to use, if desired.

In order to configure the infant adaptable system for its use, a first fastener is mounted along one side of the base member. Additionally, a second fastener is mounted on the base member along its other side. Consequently, with an engagement of the first fastener to the second fastener, the infant adaptable system is generally configured as a hollow cylinder. For purposes of the present invention, one fastener of the infant adaptable system can be made of loops or hoops and the other fastener can be made of hooks. Other structures for engagement are also envisioned for the present invention. In any event, when the fasteners are engaged with each other, the system is configured to fit around an arm of a user, or around a handle of an infant carrier, such as a car seat or a stroller.

BRIEF DESCRIPTION OF THE DRAWINGS

The novel features of this invention, as well as the invention itself, both as to its structure and its operation, will be best understood from the accompanying drawings, taken in conjunction with the accompanying description, in which similar reference characters refer to similar parts, and in which.

DESCRIPTION OF THE PREFERRED EMBODIMENTS

Figure 1:
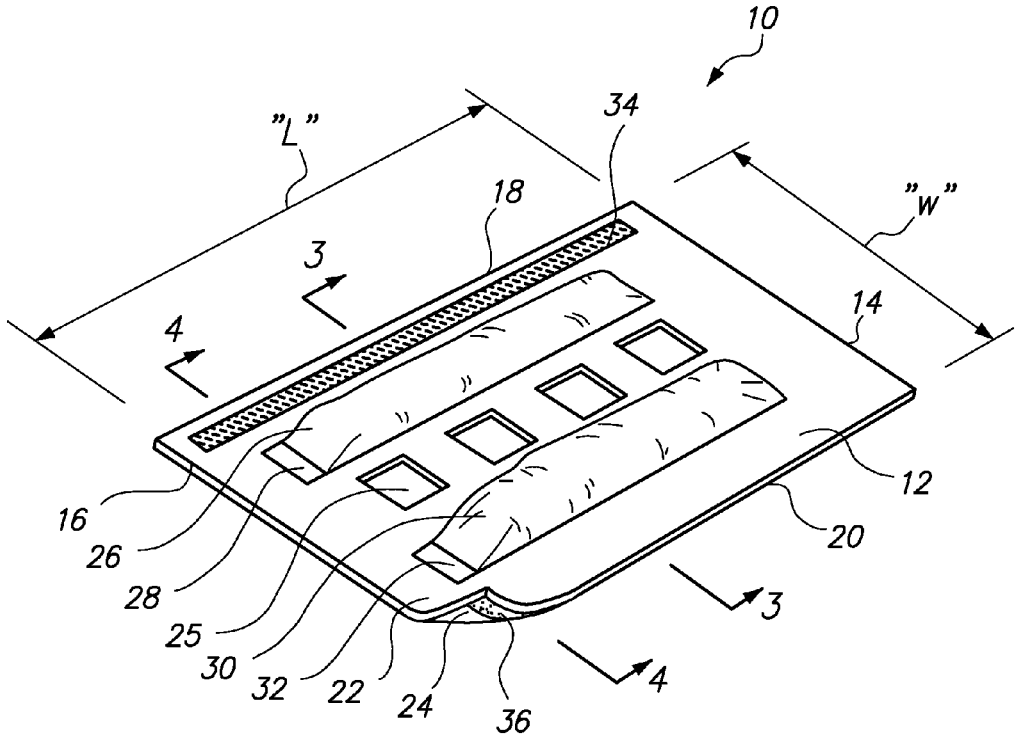
FIG. 1 is a perspective view of an infant adaptable system in accordance with the present invention.

Referring initially to FIG. 1, an infant adaptable system is shown and is generally designated 10. As shown, the system 10 is a substantially rectangular base member 12 having a top edge 14 and a bottom edge 16, with each edge 14 and 16 having a width "w". Extending between the edges 14 and 16 are substantially parallel sides 18 and 20, with each side 18 and 20 having a length "L". Further, the base member 12 has a top surface 22 and a bottom surface 24. Preferably, the base member 12 is made of a soft, flexible fabric material.

As also shown in FIG. 1, the base member 12 is formed with a plurality of holes 25 which are positioned intermediate the sides 18 and 20, with the plurality of holes 25 aligned substantially parallel to the sides 18 and 20. Accordingly, the sides 18 and 20, as well as the plurality of holes 25, are mutually parallel to an unspecified axis (not shown). Additionally, in FIG. 1 it is shown that the base member 12 includes a first pocket 26 having an opening 28, and it includes a second pocket 30 having an opening 32.

Figure 2:
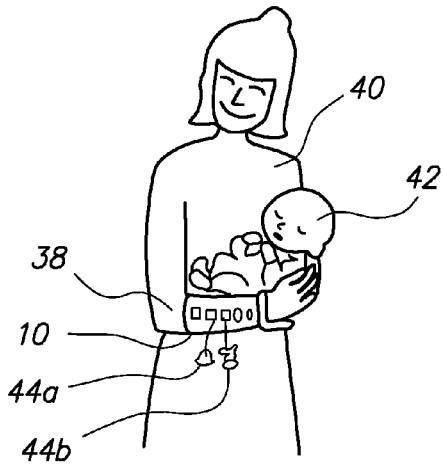
FIG. 2 shows the infant adaptable system of the present invention in use while an infant is being carried by a user of the system (parent or nurse)

Still referring to FIG. 1, the base member 12 is shown to have a fastener 34 positioned on the top surface 22 of the base member 12 along the side 18. Similarly, another fastener 36 is positioned on the bottom surface 24 of the base member 12 along the side 20. Within this arrangement, when the fasteners 34 and 36 are engaged with each other, the base member 12 is substantially configured to form a hollow, cylindrical shaped structure, such as evidenced for the system 10 as shown in FIG. 2. Preferably, the fasteners 34 and 36 are of a well-known "Hooks and Loops" type engagement system, but, as will be appreciated by the skilled artisan, the fasteners 34 and 36 can be of any other type well known in the pertinent art.

Figure 3:
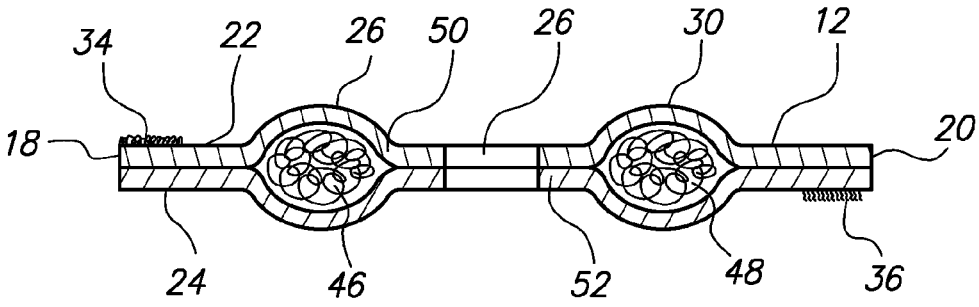
FIG. 3 is a cross section view of the system of the present invention as seen along the line 3-3 in FIG. 1.

Referring now to FIG. 2, the system 10 is shown configured for engagement with the forearm 38 of a user 40 (parent or nurse), while the user 40 is carrying an infant 42. Further, FIG. 2 shows that while the infant 42 is being carried, a variety of playthings (e.g. toys 44*a* and 44*b*) can be selectively suspended from respective holes 25 of the base member 12. In FIG. 3 it is shown that the first pocket 26 can be filled with a cushion 46, and that the second pocket 30 can be filled with a cushion 48. In most cases, both cushion 46 and cushion 48 will be made of the same material. Preferably, the material used for cushions 46 and 48 may be either pillow batting, beads or memory foam. Other well-known materials can, of course, be used. In the event, when a material such as beads are used for the cushions 46 and/or 48, the material may be warmed for the comfort of the infant 42.

Figure 4:
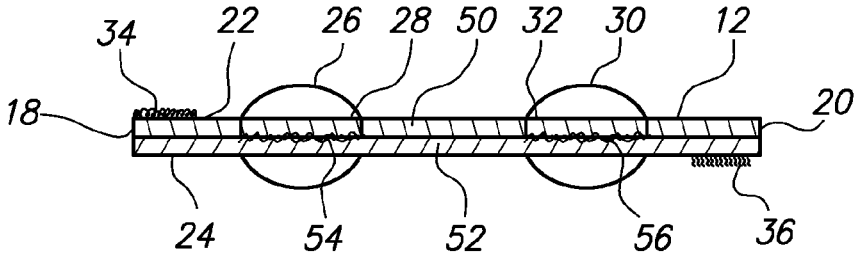
FIG. 4 is a cross section view of the system of the present invention as seen along the line 4-4 in FIG. 1.
Figure 5:
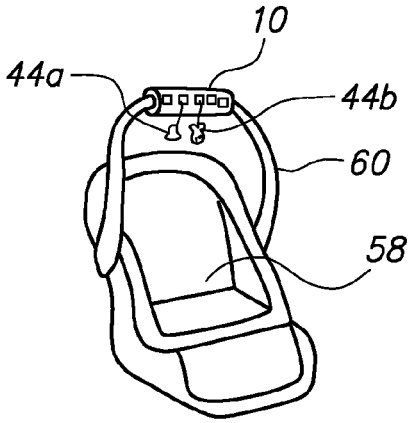
FIG. 5 is a perspective view of a mobile contrivance for transporting an infant using the system of the present invention.

Both FIG. 3 and FIG. 4 also indicate that the base member 12 can be made using a first base sheet 50 and a second base sheet 52. With this structure, the first base sheet 50 and the second base sheet 52 can be joined together in any manner that is well known in the pertinent art, such as by sewing. Further, FIG. 4 indicates that the opening 28 of the first pocket 26 can be selectively opened and closed by a fastener 54 in order to insert/remove the cushion 46 (see FIG. 3) into/from the first pocket 26. Likewise, the fastener 56 is provided for the same purpose with regard to the second pocket 30. Also, as implied above, the system 10 is useable with a mobile contrivance such as a car seat 58. If used, FIG. 5 shows that the system 10 can be engaged with the handle 60 of the car seat 58 and either used to ease the carrying of the car seat 58, or provide a means for providing an infant 42 with easy access to playthings (e.g. toys 44*a* and 44*b*).

While the particular Toy Sleeve as herein shown and disclosed in detail is fully capable of obtaining the objects and providing the advantages herein before stated, it is to be understood that it is merely illustrative of the presently preferred embodiments of the invention and that no limitations are intended to the details of construction or design herein shown other than as described in the appended claims.

What is claimed is:

1. An infant adaptable system which comprises:

a substantially rectangular shaped base member made of a flexible material, wherein the base member has a first edge and a second edge with a first side and a second side extending therebetween, and wherein the base member defines an axis substantially parallel to the first side and the second side;

a plurality of holes formed into the base member, wherein the holes are aligned substantially parallel to the axis between the first and second sides;

a first cushion mounted on the base member between the plurality of holes and the first side of the base member, and having a length aligned substantially parallel to the axis;

a second cushion mounted on the base member between the plurality of holes and the second side of the base member, and having a length aligned substantially parallel to the axis;

a first fastener mounted on the base member along the first side thereof; and a second fastener mounted on the base member along the second side thereof for engagement with the first fastener to position the system for an adaptation for the infant.

2. A system as recited in claim 1 wherein the first cushion and the second cushion are made with pillow batting.

3. A system as recited in claim 1 wherein the first cushion and the second cushion are made with beads.

4. A system as recited in claim 1 wherein the first cushion and the second cushion are made with memory foam.

5. A system as recited in claim 1 wherein the first fastener is made of loops and the second fastener is made of hooks.

6. A system as recited in claim 1 wherein the system, with the first fastener engaged with the second fastener, is configured to fit the system around an arm of a user.

7. A system as recited in claim 1 wherein the system, with the first fastener engaged with the second fastener, is configured to fit the system around a handle of an infant carrier.

8. A system as recited in claim 1 wherein the base member is formed with a first pocket having an opening for receiving the first cushion into the first pocket through the opening.

9. A system as recited in claim 1 wherein the base member is formed with a second pocket having an opening for receiving the second cushion into the second pocket through the opening.

10. A system as recited in claim 1 wherein the first side and the second side each have a substantially same length "L", and wherein the first edge and the second edge each have a substantially same width "w" wherein "L" is greater than "w".

11. A system as recited in claim 1 wherein the flexible material is a fabric.

12. An infant adaptable system which comprises:

a first base sheet, wherein the first base sheet is substantially rectangular shaped and is made of a flexible material, and the first base sheet has a first edge and a second edge with a first side and a second side extending therebetween;

a second base sheet, wherein the second base sheet is substantially rectangular shaped and is made of a flexible material, and the second base sheet has a first edge and a second edge with a first side and a second side extending therebetween, and further wherein the respective first and second edges of the first and second base sheets are affixed to each other and the respective first and second sides of the first and second base sheets are affixed to each other to create a base member, and wherein the base member defines an axis substantially parallel to the first and second sides;

a plurality of holes formed into the base member, wherein the holes are aligned substantially parallel to the axis;

a first pocket created on the base member and formed with an opening to receive a first cushion therein between the first and second base sheets, wherein the first pocket is located intermediate the plurality of holes and the first side of the base member, and has a length aligned substantially parallel to the axis;

a second pocket created on the base member and formed with an opening to receive a second cushion therein between the first and second base sheets, wherein the second pocket is located intermediate the plurality of holes and the second side of the base member, and has a length aligned substantially parallel to the axis;

a first fastener mounted on the base member along the first side thereof; and a second fastener mounted on the base member along the second side thereof for engagement with the first fastener to position the system for an adaptation for the infant.

13. A system as recited in claim 12 wherein the first cushion and the second cushion are made of a material selected from a group comprising pillow batting, beads and memory foam.

14. A system as recited in claim 12 wherein the first fastener is made of loops and the second fastener is made of hooks.

15. A system as recited in claim 12 wherein the first side and the second side each have a substantially same length "L", and wherein the first edge and the second edge each have a substantially same width "w" wherein "L" is greater than "w".

16. A system as recited in claim 12 wherein the flexible material is a fabric.

17. A method for manufacturing an infant adaptable system which comprises the steps of:

providing a substantially rectangular shaped base member made of a flexible material, wherein the base member has a first edge and a second edge with a first side and a second side extending therebetween, and wherein the base member defines an axis substantially parallel to the first side and the second side;

forming a plurality of holes into the base member, wherein the holes are aligned substantially parallel to the axis between the first and second sides;

creating a first cushion on the base member between the plurality of holes and the first side of the base member with the first cushion having a length aligned substantially parallel to the axis, and a second cushion on the base member between the plurality of holes and the second side of the base member with the second cushion having a length aligned substantially parallel to the axis;

mounting a first fastener along the first side of the base member, and a second fastener mounted along the second side of the base member for engagement with the first fastener to position the system for an adaptation for the infant.

18. A method as recited in claim 17 wherein the first cushion and the second cushion are made of a material selected from a group comprising pillow batting, beads and memory foam.

19. A method as recited in claim 17 wherein the first fastener is made of loops and the second fastener is made of hooks.

20. A method as recited in claim 17 wherein the first side and the second side of the base member each have a substantially same length "L", and wherein the first edge and the second edge of the base member each have a substantially same width "w" wherein "L" is greater than "w", and further wherein the flexible material is a fabric.

* * * * *